United States Patent [19]

Aarons

[11] 4,024,685

[45] May 24, 1977

[54] RIDGE AND HIP CAPPING FOR ROOFS

[75] Inventor: Raymond Joseph Aarons, Jindalee, Australia

[73] Assignee: Monier Colourtile Pty. Ltd., Darra, Australia

[22] Filed: May 14, 1976

[21] Appl. No.: 686,552

[52] U.S. Cl. ..... 52/278; 52/57; 52/276; 52/466; 52/544

[51] Int. Cl.[2] ..... L04B 7/06

[58] Field of Search ..... 52/41–44, 52/57, 462, 461, 464, 466, 467, 276, 278, 544, 547, 549, 550

[56] References Cited

UNITED STATES PATENTS

| | | | |
|---|---|---|---|
| 272,859 | 2/1883 | Cox | 52/461 |
| 430,370 | 6/1890 | Babcock | 52/57 |
| 3,798,853 | 3/1974 | Castle | 52/57 |

FOREIGN PATENTS OR APPLICATIONS

| | | | |
|---|---|---|---|
| 591,438 | 7/1925 | France | 52/550 |
| 800,784 | 12/1950 | Germany | 52/547 |
| 44,475 | 6/1908 | Switzerland | 52/547 |
| 121,052 | 8/1926 | Switzerland | 52/276 |
| 1,217,897 | 12/1970 | United Kingdom | 52/43 |
| 284,925 | 2/1928 | United Kingdom | 52/547 |

*Primary Examiner*—Price C. Faw, Jr.
*Assistant Examiner*—Henry Raduazo

[57] ABSTRACT

A method of anchoring ridge-capping or hip-capping to the structure of a building. A rail fitted with a series of clips moveable therealong is secured to a hip- or ridge-board. Flanges on the clips engage the upper surfaces of a series of end-to-end cap sections forming a continuous roof capping above the rail. The clips are adjustable to suit individual applications.

7 Claims, 5 Drawing Figures

RIDGE AND HIP CAPPING FOR ROOFS

BACKGROUND OF THE INVENTION

This invention relates to a system of fixing roofing ridge- or hip-capping using a clip of the type having cap pieces mounted end-to-end to form a continuous capping, said clip including an upright lower part having anchoring means to attach it to the building structure, an upper part including a depending section to pass between adjacent cap pieces and surmounted by a top section to overlie the top surfaces of both said cap pieces, and an attachment between said upright lower part and said depending section.

The invention also relates to a fixing system making use of clips similar to that described.

SUMMARY OF THE INVENTION

It is an object of this invention to provide such a system by which ridge-capping or hip-capping (for convenience referred to generally as "capping") is positively anchored to the building structure.

It is a further object to provide a system adaptable to different types of capping, which is easy and quick to install and the elements of which can be pre-fabricated and delivered ready for use on site.

Accordingly, the invention comprises a roof ridge-cap or hip-cap assembly including; a rail; fixing means for mounting said rail longitudinally to a ridge- or hip-board; a series of end-to-end cap sections forming a continuous roof capping above said rail; a series of clips each slidably engaged on said rail and each passing up between adjacent cap sections; and flanges on each clip bearing upon the upper surface of both said adjacent cap sections.

The clips are preferably of adjustable length between said rail and said flanges.

The rail is preferably fixed down by clips attached to the roof rafters and overlying rail flanges resting on said board.

SHORT DESCRIPTION OF THE DRAWINGS

In order that the invention may be better understood, it will be described in more detail with reference to the accompanying drawings, in which.

DETAILED DESCRIPTION OF THE PREFERRED EMBODIMENT OF THE INVENTION

Figure 1:
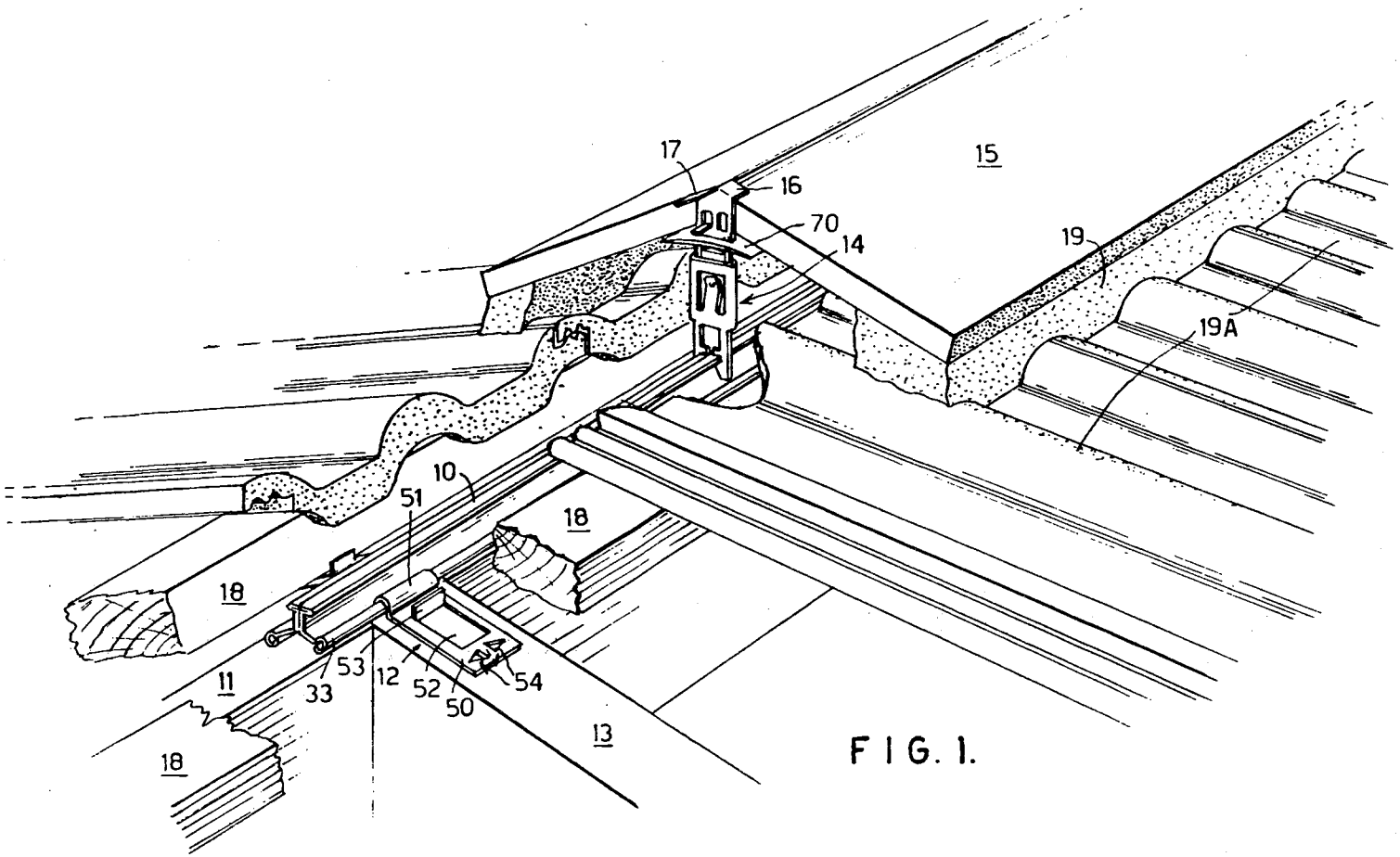
FIG. 1 shows a partly broken-away view of an embodiment of the invention using butted ridge cap-sections.

In board principle, the assembly shown in FIG. 1 comprises a ridge track or rail 10 lying along a ridge board 11 and secured by clips 12 at each side attached to roof rafters 13. A two-part clip 14 of adjustable length is slidably attached to rail 10 at its lower end and passes up between the abutting ends of ridge-cap sections (one being shown at 15). Clip 14 has oppositely-extending flanges 16, 17 contacting the upper surfaces of both adjacent sections 15, to hold them firmly in place.

Figure 2:
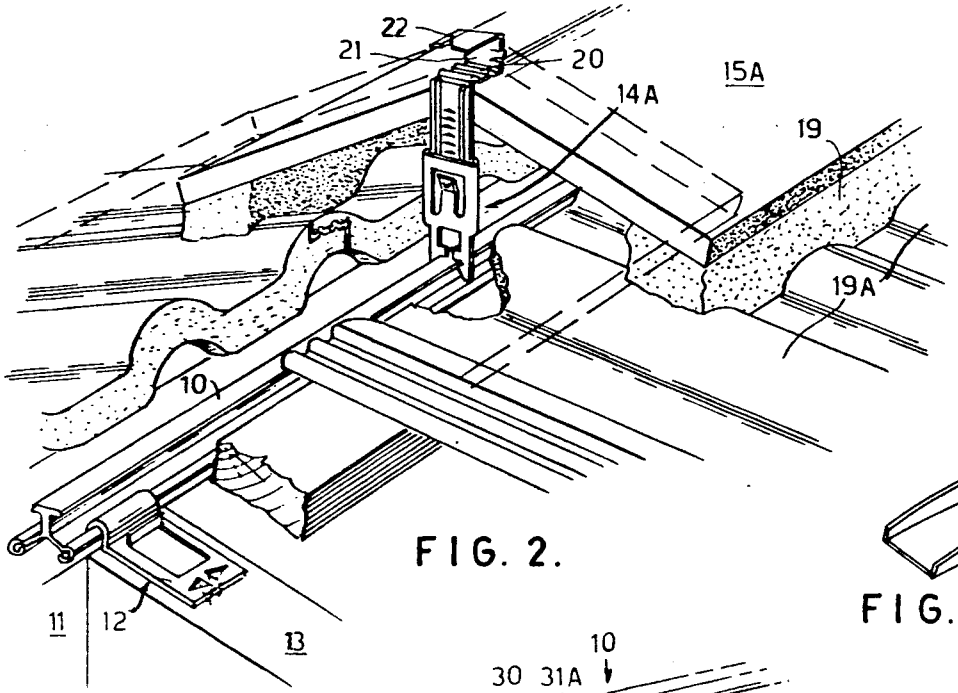
FIG. 2 is a similar view of an embodiment using lapped ridge cap-sections.
Figure 3:
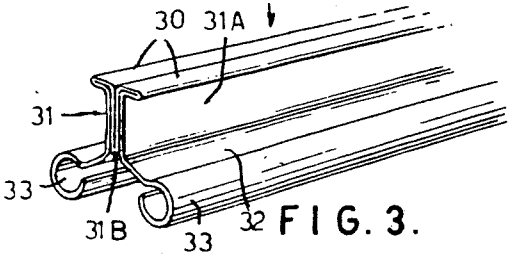
FIG. 3 shows an isometric view of the track of FIGS. 1 and 2, to enlarged scale.

FIG. 2 assembly is the same in principle as FIG. 1, but here cap-sections 15A are lapped rather than butted. Clip 14A is modified to have a flange 20 passing between the lapped surfaces of sections 15A, an upward web 21 passing across the edge of the upper section and a flange 22 lying on the upper surface of the upper section. Therefore once again the clip has flanges 20, 22 bearing on the upper surfaces of adjacent ridge sections 15A. Referring to FIG. 3, rail 10 is roll-formed from sheet metal and has upper opposite flanges 30 extending from vertical web 31, with lower flanges 32 rolled at 33 along its edges. Rail 10 is folded from an elongated sheet of metal. Outer portions 31A of web 31 lie about a re-entrant downward portion 31B to give quadruple thickness (and hence great rigidity and strength) to web 31. Flanges 30 are re-entrantly folded to give double thickness.

Rail 10 can thus be folded from relatively thin-gauge metal sheet and yet be very strong.

The rail clip 12 (FIGS. 1 and 2) has a flat plate 50 ending in an open hooked end 51. an aperture 52 in plate 50 is bordered by a transverse upstanding plate 53 between the aperture 52 and end 51, and a pair of downward prongs at 54 are struck out of plate 50.

Rail 10 is placed upon ridge board 11 and end 51 of clips 12 are engaged with each rolled edge 33 of track 10. Prongs 54 are driven into rafter 13 to hold the clips steady. Tiling battens 18 are then placed against aligning plates 53 on each side of the rail 10 and nailed through apertures 52 of clips 12 to rafters 13. The clips 12 are therefore held tightly down on rafters 13 by the tiling battens, and in turn secure rail 10 immovably in place.

Since rolled edge 51 fits closely on rolled edge 33 any roof pitch whether positive (ridges or hips) or negative (vallies) can be accommodated without modification of rail 10 or clip 12.

Figure 4:
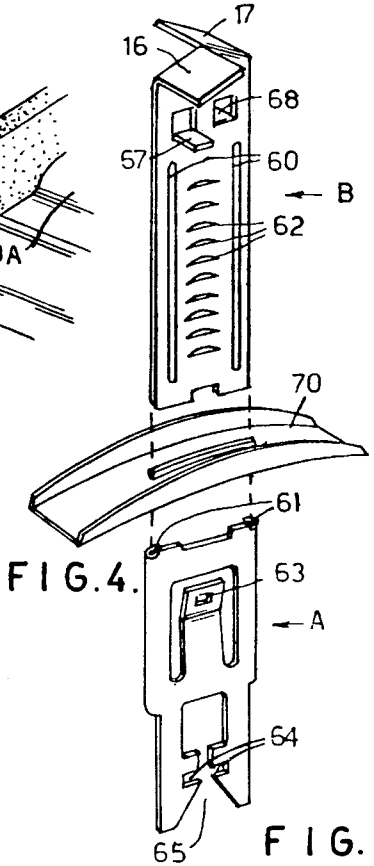
FIG. 4 shows an enlarged view of a tile clip as used in FIG. 1, the clip being shown with its two parts disengaged.
Figure 5:
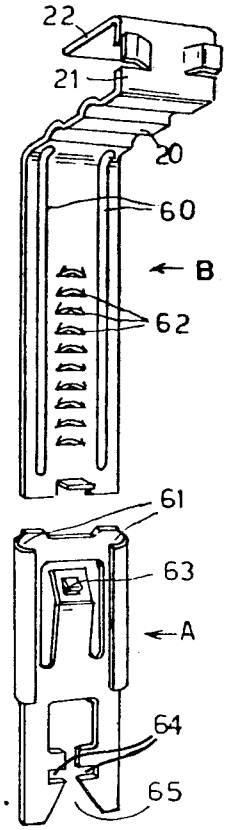
FIG. 5 is a similar view of the tile clip used in FIG. 2.

Referring to FIGS. 4 and 5 tile clips 14 and 14A are shown for use with the assemblies of FIG. 1 or FIG. 2 respectively. Each clip comprises a lower Part A and an upper Part B, edge beads 60 on Part B being slidably engageable in opposed edge grooves 61 in Part A, so that the length of each clip is adjustable. The body of B has a ratchet 62 formed of press-out teeth along it, and Part A carries a resilient tooth 63 to engage ratchet 62 and prevent extension movement between the two parts.

The lower end of Part A is provided with slots 64 opening from a cut-out 65 in the bottom edge.

Slots 64 accommodate flanges 30 of rail 10 slidably, web 31 lying through cut-out 65 Part B carries a small lug 66 (best shown in FIG. 5) which prevents Part B being engaged to Part A wrong-way-round.

Part B in FIG. 4 carries oppositely-extending lugs 16, 17 previously referred to with reference to FIG. 1, while Part B of FIG. 5 has the transverse channel-shaped section formed by flanges 20, 22 and web 21, as described with reference to FIG. 2.

FIG. 4 shows lugs 67, 68 below lugs 16, 17. These engage the upper surfaces of adjacent sections 15 (FIG. 1) and allow sections 15 to exert a compressive force downwards on Part B and therefore to contract clip 15 as the structure of FIG. 1 settles after installation. Clip 14A of FIG. 5 is similarly contracted by pressure on flange 20.

In use, the rail 10 and clips 12 are secured as described above. Clips 14 or 14A are assembled with a flashing washer 70 (FIG. 1) on Part B thereof and are slid onto rail 10. As each section 15 or 15A is bedded and pointed at 19 on tiles 19A, an appropriate clip 14 or 14A is moved along rail 10 to engage the free edge of the section, the Part B being then pressed down to hold the section firmly in place by engagement of ratchet 62 and tooth 63.

Clips 14 or 14A can contract under the weight of sections 15 or 15A as they settle into place, but cannot be extended. Each section is therefore held firmly down at each end by a clip to rail 10 and therefore via clips 12 to the roof structure.

Assembly is quick and involves a minimum of labour-time.

While embodiments have been described in detail which relate to ridge-caps, the same construction can clearly be applied to roof hips or roof vallies, and various other changes and modifications may be made in the arrangements described without departing from the invention claimed.

I claim:

1. A ridge-cap or hip-cap assembly for a roof, comprising: a rail; oppositely extending top flanges on said rail; fixing means for mounting said rail longitudinally to a ridge- or hip-board; a series of end-to-end cap sections forming a continuous roof capping above said rail; a series of clips each slidably engaged on said rail and each passing up between adjacent cap sections; flanges on the upper end of each clip, bearing upon the upper surfaces of both said adjacent cap sections; and oppositely extending slots at the lower end of each clip slidably engaging said top flanges on said rail; said rail having a flanged base resting on said board, substantially cylindrical rolled outer edge on either side of said base and a central vertical web between said top flanges and said base.

2. As assembly as claimed in claim 1, in which said rail is formed by longitudinal folding of an elongated sheet metal piece to form said rolled edges, outer upright portions of said web, re-entrantly folded top flanges of double thickness, and a central re-entrantly folded downward portion of said web between said outer portions, whereby said web is of quadruple thickness.

3. An assembly as claimed in claim 1, in which each said clip includes an upper and a lower part slidably engaged with each other; and ratchet means between said parts preventing extension of the clip length, but allowing contraction thereof.

4. An assembly as claimed in claim 3, in which said cap sections are butted end-to-end and the upper portion of said clip includes a planar part passing up between the ends of said sections, said flanges extending oppositely from the top edge of said planar part, and a pair of lugs extend oppositely from said planar part to lie adjacent the lower surface of said sections.

5. An assembly as claimed in claim 3, in which said cap sections are lapped and the upper portion of said clip includes a first horizontal flange lying between the lapped edges of said sections, a vertical web lying over the exposed edge of the upper section and a second horizontal flange lying over the upper surface of said upper section.

6. A ridge-cap or hip-cap assembly for a roof, comprising: a rail; fixing means for mounting said rail longitudinally to a ridge- or hip- board; a series of end-to-end capped sections forming a continuous roof capping above said rail; a series of clips each slidably engaged on said rail and each passing up between adjacent cap sections; and flanges on the upper end of each clip, bearing upon the upper surfaces of both said adjacent cap sections; said rail having a flanged base resting on said board, a substantially cylindrical rolled outer edge on either side of said base, wherein said fixing means includes a rail clip having a body attachable to the structure of the roof, and a hook-like rolled edge engaging over one said rolled edge of the base.

7. An assembly as claimed in claim 6, wherein said body is a flat plate held to a roof rafter by an overlying tiling batten secured to the rafter.

* * * * *